US005865231A

United States Patent [19]

Korhonen et al.

[11] Patent Number: 5,865,231

[45] Date of Patent: Feb. 2, 1999

[54] METHOD AND APPARATUS FOR PATCHING PLYWOOD

[75] Inventors: Markku Korhonen; Erkki Kauranen; Aarno Luukkonen, all of Kajaani, Finland

[73] Assignee: Mecano Group Oy, Kajaani, Finland

[21] Appl. No.: 875,913

[22] PCT Filed: Feb. 27, 1996

[86] PCT No.: PCT/FI96/00115

§ 371 Date: Aug. 6, 1997

§ 102(e) Date: Aug. 6, 1997

[87] PCT Pub. No.: WO96/26816

PCT Pub. Date: Sep. 6, 1996

[30] Foreign Application Priority Data

Feb. 28, 1995 [FI] Finland ..... 950915

[51] Int. Cl.[6] ..... B27G 1/00

[52] U.S. Cl. ..... 144/332; 144/24.16

[58] Field of Search ..... 144/2.1, 24.16, 144/330, 332

[56] References Cited

U.S. PATENT DOCUMENTS 2,663,332 12/1953 Peterson ..... 144/24.16
2,936,802 5/1960 Skoog ..... 144/24.16
4,388,956 6/1983 Hasegawa .

FOREIGN PATENT DOCUMENTS 615673 3/1961 Canada ..... 144/24.16
FI 72072 4/1987 Finland .

*Primary Examiner*—W. Donald Bray
*Attorney, Agent, or Firm*—Panitch Schwarze Jacobs & Nadel, P.C.

[57] ABSTRACT

The invention relates to a method and apparatus for patching plywood or the like. In the method, a defective portion (A) is removed from a plywood board (2) with a linearly moveable punch means (7) arranged above the board and having a blade edge **(7*a*). In the method, a patch (11) is removed from a patch board (10) and the patch (11) is placed at that point (B) of the plywood board (2) from which the defective portion (A) has been removed. According to the invention, the patch (11) is cut from the patch board (10) and the patch (11) is inserted into the plywood board (2) with the same linearly moveable punch means (7) above the board with which the defective portion (A) has been removed from the plywood plate (2)** a moment earlier.

12 Claims, 7 Drawing Sheets

Figure 1:
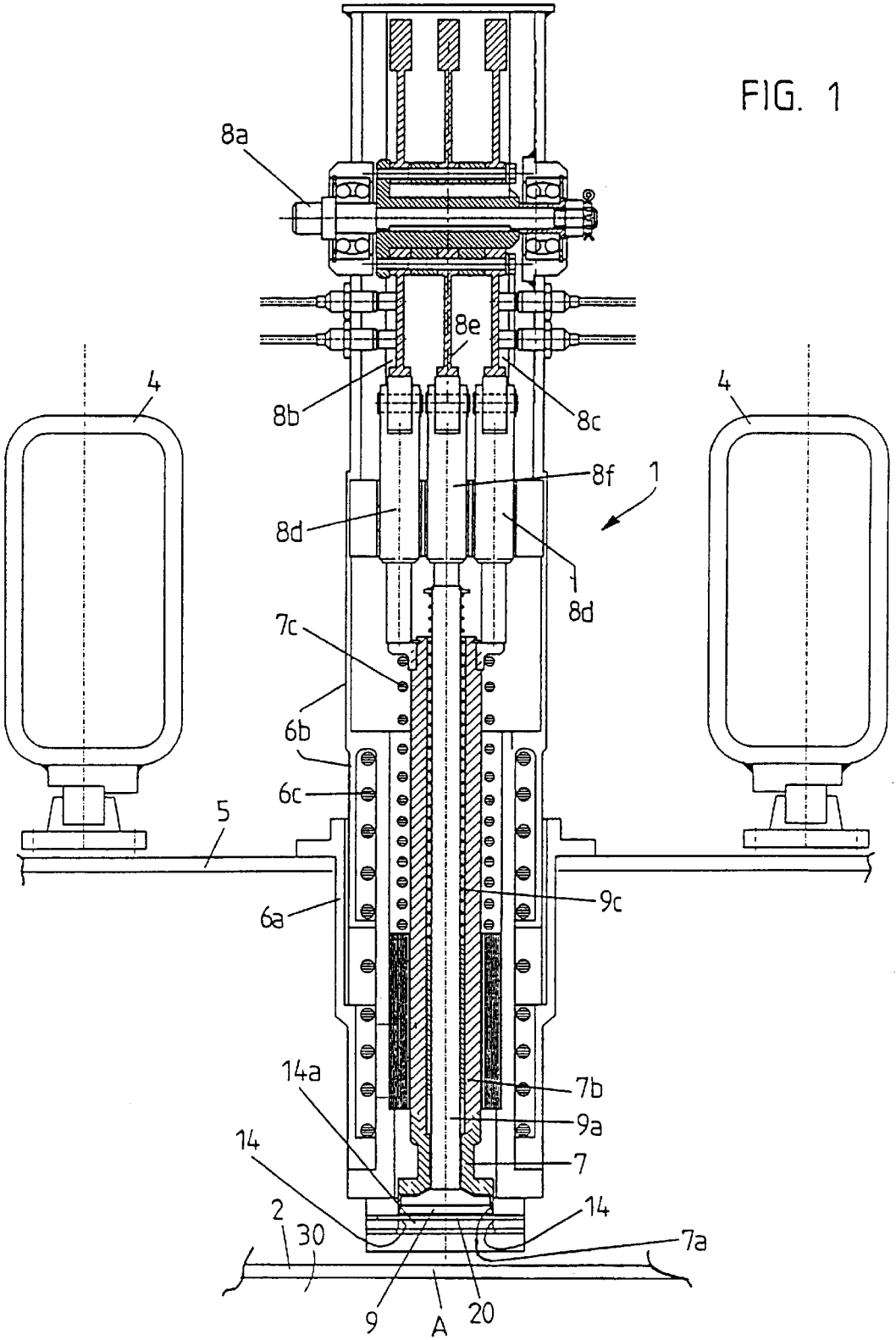

11
20
B
13
30
12
10
2
A
40b
9a
7
C
30
B
9
20
40
12
40a

METHOD AND APPARATUS FOR PATCHING PLYWOOD

The invention relates to a method for patching plywood or the like by removing a defective portion from a plywood board with a linearly moveable punch means arranged above the board and having a blade edge, and by cutting a patch from a patch board and placing the patch at that point of the plywood board from which the defective portion has been removed.

The invention also relates to an apparatus for patching plywood or the like, the apparatus comprising a linearly moveable punch means arranged above the board and having a blade edge, the apparatus further comprising means for making the punch means move linearly through the plywood board against a counter plate below the plywood board in order to remove a defective portion from the plywood board, and the apparatus further comprising a feed space into which a patch board from which the necessary patch will be cut is fed.

The present invention is especially well-suited for patching veneer, but it is also useful for other applications.

In the prior art methods and apparatuses, the apparatus comprises a double jaw structure with a blade in each jaw, the plywood board to be patched being placed between the blades. The defective portion is removed with the upper blade, and the patch is formed and put in place from below with the lower blade, while the upper blade functions as a counterpart. The known apparatuses are very large, weighing several tonnes, since in the known solutions, a large mass is needed to ensure accuracy. The apparatuses cannot be moved, but a human being is needed to move the plywood boards in relation to the apparatus. These apparatuses are difficult to automate. The prior art also discloses apparatuses with a rotary cutting blade for removal of a defective portion and with a separate pressing means or the like for putting an earlier formed patch in place. The fact that different means arranged in different places are used impairs accuracy, slows the operation, makes the apparatus more complicated in structure and adds to the expenses.

Further, FI 72,072 teaches a method and apparatus in which an upper blade is used for cutting a patch, but in some embodiments known from the reference the blade cuts the patch before the defective portion has even been removed, since the patch board is above the plywood board below the blade, like the plywood board. In some embodiments described in the reference, the patch board is below the plywood board to be patched, and a hoist is arranged below it to lift the patch to the proper place. The necessary operations, i.e. removal of a defective portion, cutting of a patch and putting it in place, are not performed in the above order, and therefore we consider the order less than ideal. In the above solution, the blade surrounds the patch when the patch is placed in the opening punched in the plywood board. To our understanding, a patch attached with an apparatus of the type described above is not secured firmly, since the blade surrounds the patch when it is put in place, and so the blade will have to be raised from around the patch once the patch is in place.

The object of the present invention is to provide a new kind of method and apparatus in which the problems involved in the prior art solutions are avoided.

The object is achieved by a method according to the invention, which is characterized in that the patch is cut from the patch board and the patch is inserted into the plywood board with the same linearly moveable punch means arranged above the board with which the defective portion has been removed from the plywood board a moment earlier, and that in the removal of the defective portion, the punch means is pressed downward through the plywood board against a counter plate arranged below the plywood board, that the punch means is raised, that the patch plate is placed below the punch means, that a patch is cut from the patch board with the punch means by moving the punch means linearly downward, and that the patch is inserted into the plywood plate by a further linear downward movement of the punch means.

The object is achieved with an apparatus according to the invention, which is characterized in that the punch means used for removal of the defective portion is also arranged to cut a patch from a patch board by a downward movement effected after raising the punch means and, by continuing the movement, to insert the patch into the plywood board.

The method and apparatus according to the invention are based on a single-blade principle, i.e. the cutting blade, or punch means, not only removes a defective portion but also cuts a patch from a patch board and puts it in place.

Several advantages are achieved by the method and apparatus according to the invention. The apparatus is simple and fast. All the operations are performed at the same point as linear movements, whereby the apparatus functions accurately. The apparatus can also be made very light, and so it can be moved easily above the veneer sheet conveyor. The solution of the invention allows the patches to be secured to the plywood board very firmly and reliably. In the solution of the invention, the blade need not be raised from the opening after the patch has been put in place.

Figure 2:
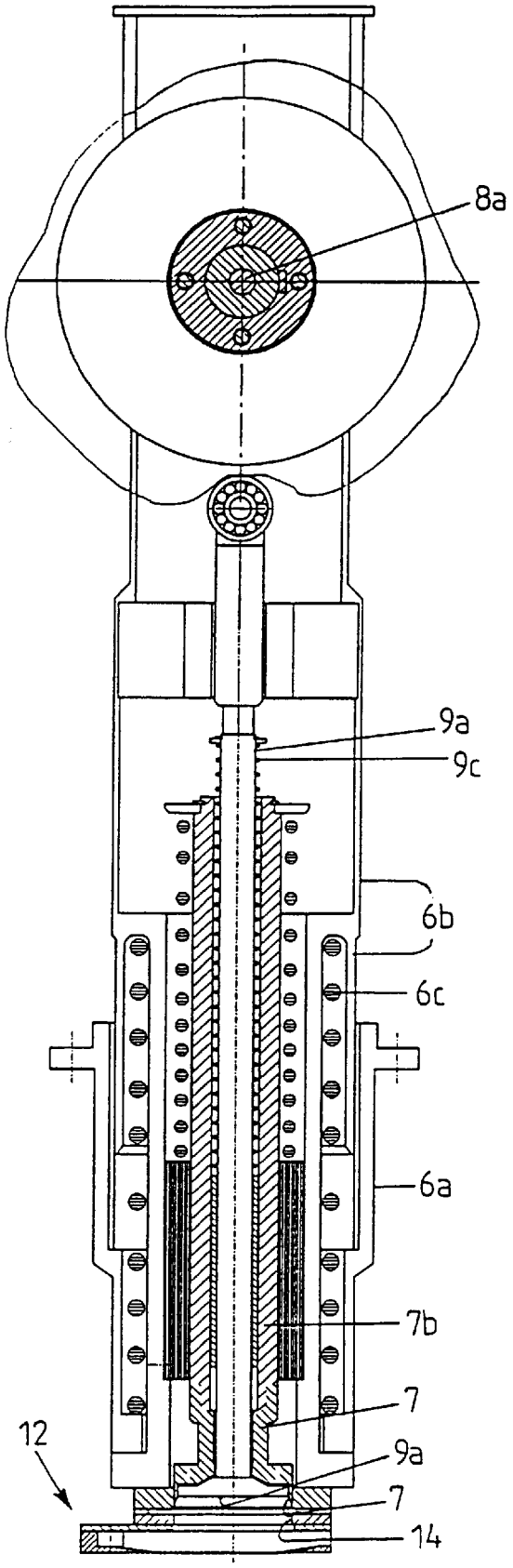
Figure 12:
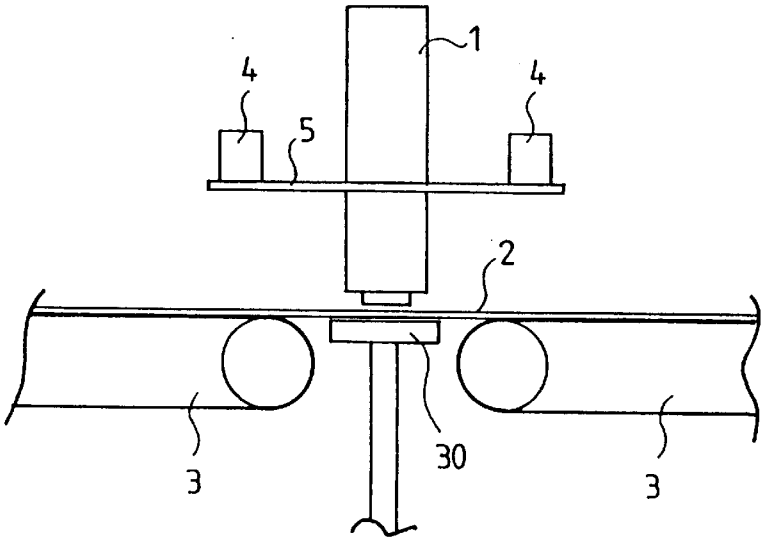

In the following, the invention will be described in greater detail with reference to the attached drawings, in which FIGS. 1 and 2 show the apparatus in cross-section, FIGS. 3 to 11 show the lower part of the apparatus with the punch means in different positions at different stages of operation, FIG. 12 shows the apparatus positioned above the plywood conveyor.

The figures, especially FIGS. 12, 1 and 2, show a patching apparatus 1, i.e. patching unit 1, arranged at a plywood 2 conveyor 3. The arrangement comprises guide bars 4 extending in the transverse direction of the conveyor 3. The apparatus 1 is attached to the guide bars 4 by means of an attaching part 5. The apparatus 1 can be moved in the direction of the guide bars 4 to a desired point, i.e. to a point of the plywood board 2 where a defective portion has been detected.

The apparatus 1 comprises a frame 6*a*, 6*b*, in which the upper frame part 6*b* can be pressed down in relation to the lower frame part 6*a*. Between the frame parts is arranged a return means 6*c*, such as a return spring 6*c*. Frame part 6*a* is fixed in the vertical direction and it is secured to the attaching part 5. Frame part 6*b* and the structures inside it move in the vertical direction in such a way that frame part 6*b* and the structures inside it can be moved in relation to frame part 6*a* and that the structures inside frame part 6*b* can be moved in relation to frame part 6*b* itself. When frame part 6*b* is pressed downward in relation to frame part 6*a*, e.g. a drop of 40 mm is effected so that the lower part of the apparatus rests against the plywood board 2. This brings us from FIG. 3 to FIG. 4.

The apparatus 1 comprises a linearly moveable punch means 7 arranged above the plywood and having a blade edge 7*a* and a rod member 7*b*. The apparatus also comprises means 8*a* to 8*d* for making the punch means 7 move linearly through the plywood board 2 against a counter plate 30 below the plywood board 2 in order to remove a defective portion A from the plywood board. Means 8*a* comprise a shaft 8*a* rotated e.g. by an electric motor or the like, and on the shaft 8*a* are arranged eccentric members 8*b*, 8*c* and slave rods 8*d* that press the rod 7*b* of the punch means 7. In connection with the punch means 7 of the apparatus 1 is also arranged a return means 7*c*, such as a return spring 7*c*, which effects a return movement when the positions of the eccentrics 8*b*, 8*c* so allow. The eccentrics are cams, the cam gear comprising three eccentric wheels 8*b*, 8*c* and 8*e*, of which the outermost two, i.e. 8*b* and 8*c*, are provided for the operation of the punch means 7 while the third wheel, i.e. the innermost wheel 8*e*, is provided for the pressing means 9 located inside the punch means 7. The electric motor revolves the cam gear 8*b*, 8*c*, 8*e* once during one cycle of operation, and this brings are step by step from FIG. 4 to FIG. 11.

The apparatus also comprises a feed space 20 into which a patch board 10 can be fed. The patch board 10 is, for example, a patch strip or the like, from which a patch 11 can be cut, after which it is inserted into that point B of the plywood board 2 from which the defective portion A has been removed, i.e. punched, with the punch means 7. In the invention, the punch means 7 used for removing the defective portion A is also arranged to cut a patch 11 from the patch board 10 and press the patch 11 to that point B of the plywood board 2 from which the defective portion A has been removed with the punch means 7.

In a preferred embodiment, the apparatus comprises a support member 12 by means of which the apparatus 1 is pressed, i.e. placed, against the plywood board 2, whereby the support member 12 presses the plywood board 2 against the counter plate 30 below the plywood board 2, the counter plate being preferably at least somewhat flexible and being coated e.g. with polyurethane. The support member 12 comprises a vertical space 13 that is open from below to allow the punch means 7 to move therein. Space 13 has lateral sides 13*a*, 13*b*, and the punch means 7 bears against the lateral sides 13*a*, 13*b* of the space 13. The essential feature is that especially that part of the punch means 7 that has a blade edge 7*a* bears against the lateral sides of space 13, since this allows the punch means 7 and thereby the blade edge 7*a* of the punch means 7 to be guided very accurately. The space 13 where the punch means 7 moves extends through the feed space 20 into which the patch board is fed. The support member 12 further comprises a counterpart 14, which surrounds space 13 below the feed space into which the patch board is fed. The above structure makes it possible to cut a patch 11 from above in a simple and reliable manner.

In a preferred embodiment, the punch means 7 comprises, and/or at the punch means 7 are arranged, means 7*d* for raising a defective portion A together with the punch means 7. In the preferred embodiment, means 7*d* are sharp outwardly projecting parts 7*d*, or other such means, arranged at the lower end of the punch means 7, the projecting parts pressing against the defective portion A. There may be one or more projecting parts 7*d*.

In a preferred embodiment, the apparatus comprises means 9, 8*a*, 8*e*, 8*f* for dropping the defective portion A from the punch means 7. Most preferably, the means for dropping the defective portion A from the punch means 7 comprise a pressing means 9 inside the punch means and means 8*a*, 8*e*, 8*f* for moving the pressing means 9 in relation to the punch means 7. Around the rod 9*a* of the pressing means 9 is arranged a return means 9*c*, such as a return spring, which raises the pressing means 9, including the rod 9*a*, when eccentric 8*e* so-allows.

The pressing means 9 also has another function: in a preferred embodiment, when a patch 11 is inserted into the plywood board 2, the pressing means 9 will support the patch A from above inside the punch means 7.

In a preferred embodiment, when a patch 11 is inserted into the plywood board 2, the blade edge 7*a* of the punch means 7 is at least slightly lower than the pressing means. This makes it possible to press the blade edge 7*a* of the punch means 7 when the patch 11 is inserted at least slightly to the seam between the plywood board 2 and the patch 11, whereby the blade edge 7*a* seals the seam.

Figure 4:
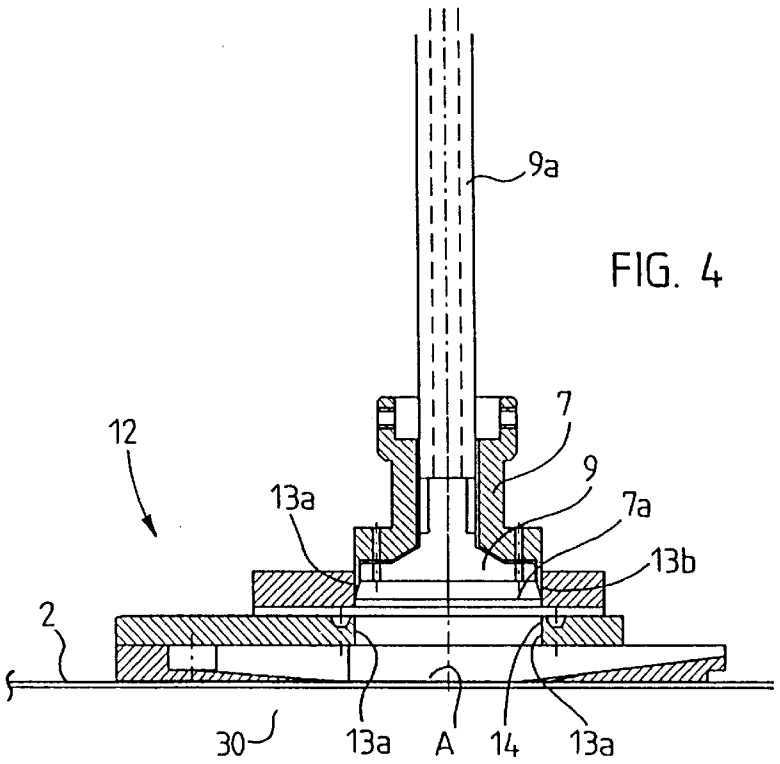
Figure 3:
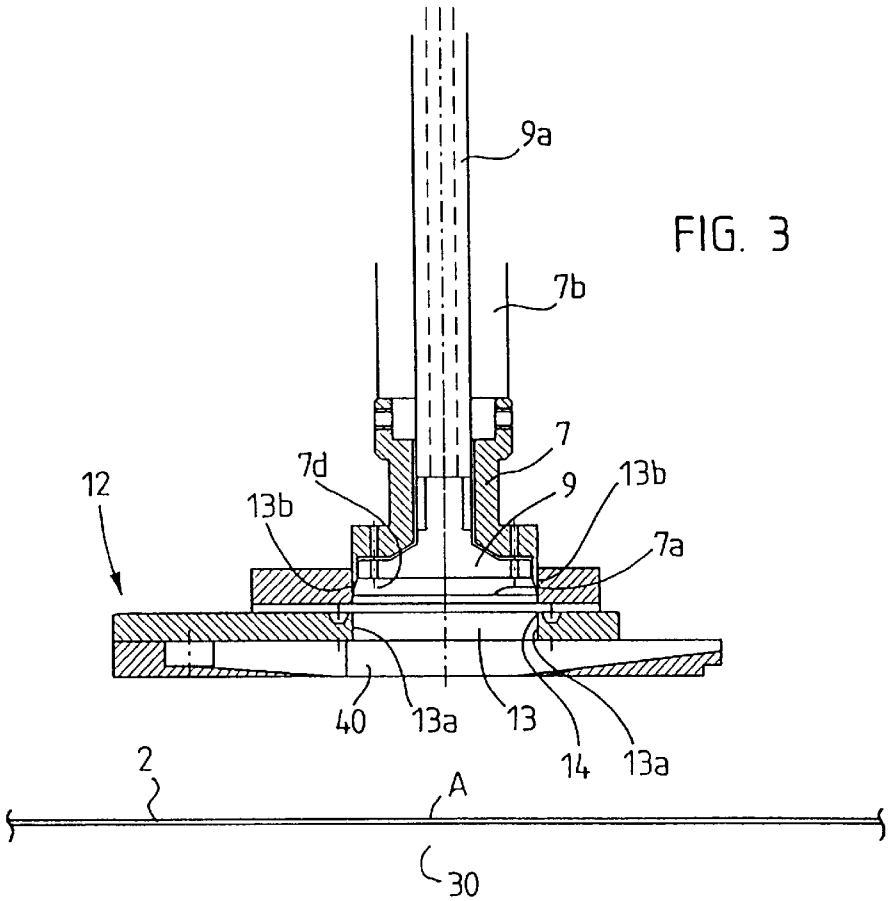

In the following, primarily the method is described. FIG. 3 shows the starting position, where the patching apparatus is not in contact with the plywood board 2. In FIG. 4, the patching unit 1, or patching apparatus 1, is lowered about 40 mm, whereby it presses the plywood board 2 against the counterpart 30, or counter plate 30, below.

Figure 5:
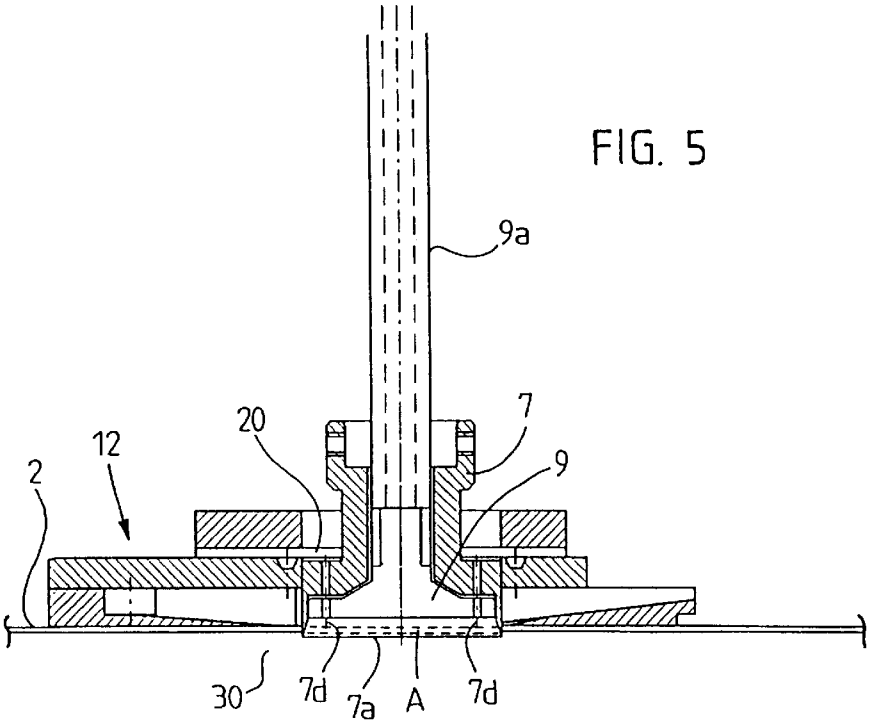

The method concerns patching of a plywood board 2 or the like. In the method, a defective portion. A is removed from the plywood board 2 with a linearly moveable punch means 7 arranged above the board and having a blade edge 7*a*. In FIG. 5, the punch means 7 is lowered, whereby the blade edge 7*a* of the punch means 7 punches the plywood board 2 at the defective portion A. When the defective portion A is removed, the punch means 7 is pressed downward through the plywood board 2 against the counter plate 30 below the plywood board 2. The projecting parts 7*d* thereby grab the defective portion A.

Figure 6:
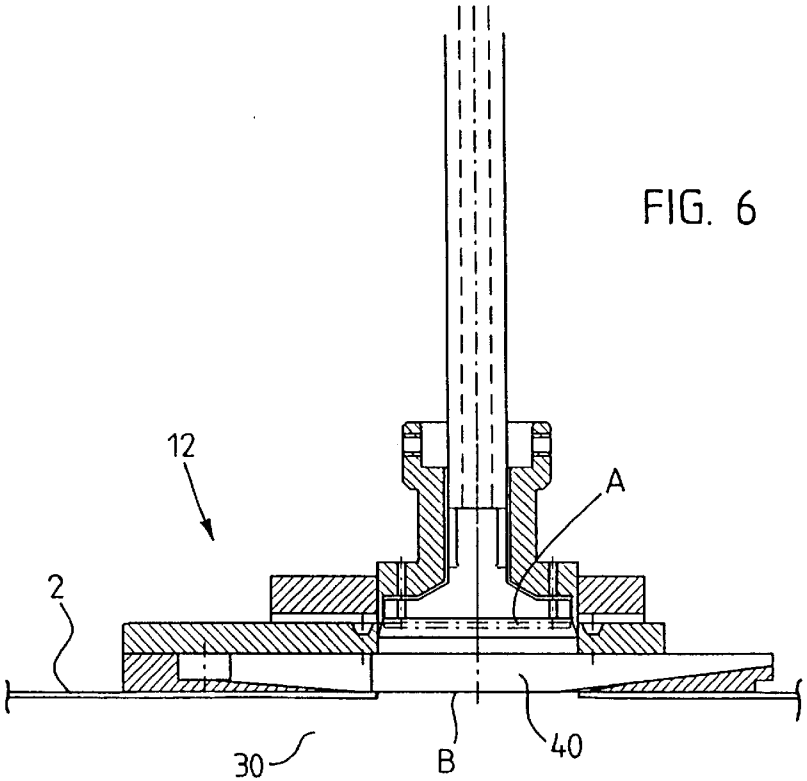
Figures 7, 8:
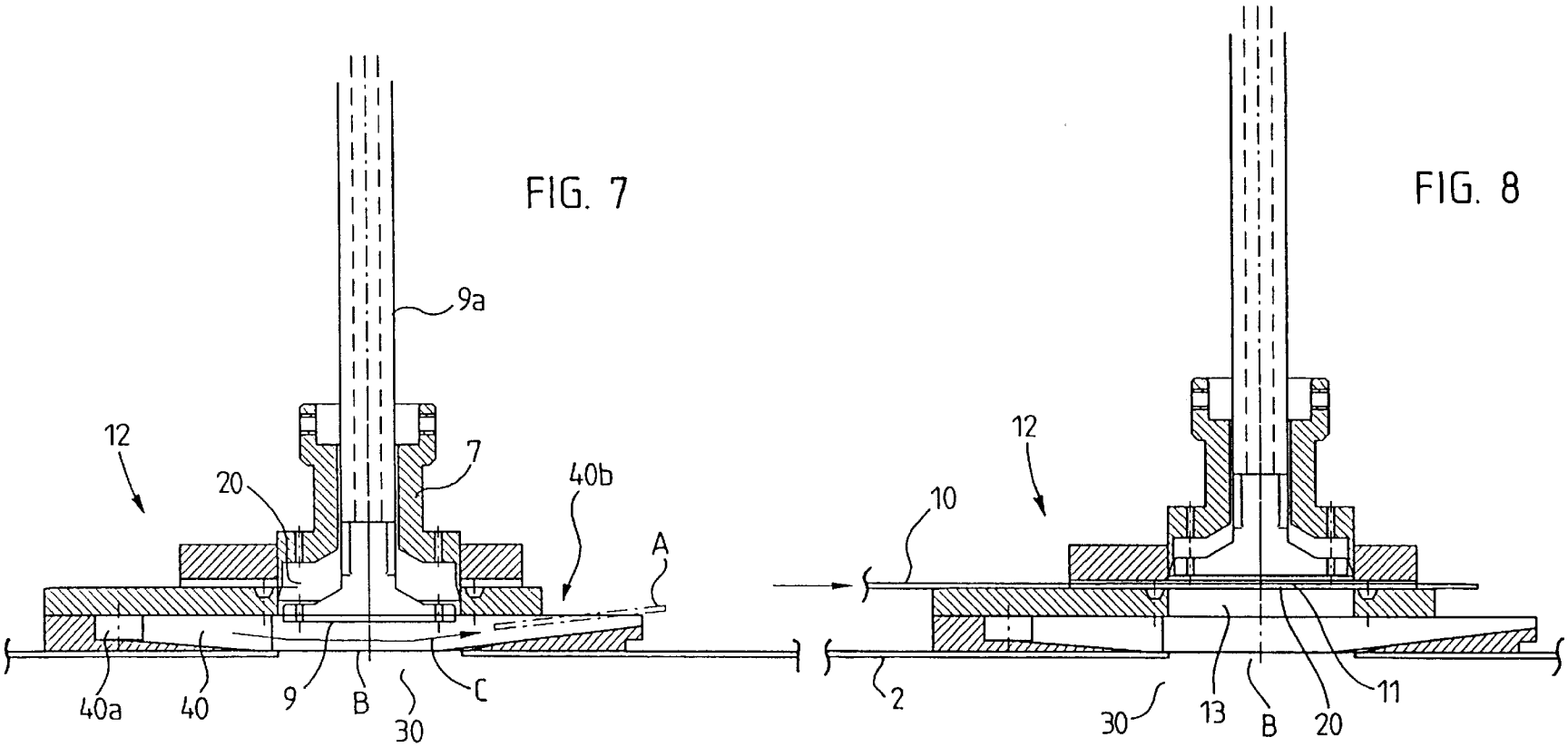

In FIG. 6, the punch means 7 carries the debris with it, i.e. defective portion A, when it is raised. The punch means 7 is raised as shown in FIG. 6, and the defective portion A is taken away as shown in FIG. 7. In a preferred embodiment, the punch means 7 raises the defective portion A that it has cut from the plywood board 2, and as shown in FIG. 7, the defective portion A is then dropped from the punch means 7 with a pressing means 9 arranged inside the punch means 7 by moving the pressing means downward. In the method illustrated in FIG. 7, the defective portion A dropped from the punch means 7 is discharged with an air flow C above the plywood board 2. Most preferably, an air flow is provided both from top to bottom in the direction of the punch means 7 and transversely through space 40 (transverse flow C) below the punch means 7. The transverse air flow C is preferably a suction flow, and the vertical air flow from the direction of the punch means is preferably a blowing flow. The apparatus, especially its support member 12 below the blade member 7*a*, thus comprises a space 40 to which the defective portion is dropped and from which it is discharged with a lateral flow C. Space 40 comprises a supply point 40*a* and a discharge point 40*b* for the air flow C, the defective portions A being naturally also discharged through the latter. This embodiment is effective and simple, and small in size, and in it all the operations are performed above the plywood board 2.

In a preferred embodiment, the punch means 7 is raised step by step such that first the punch means 7 is raised in accordance with FIG. 7 to a height where the lateral side of the punch means 7 closes the feed space 20 into which the patch board is fed. Further, before the patch board 10 is placed in the feed space 20 below the punch means 7, the punch means 7 is raised at least to such an extent that the feed space 20 is opened in accordance with FIG. 8. In FIG. 8, the punch means 7 is raised to the uppermost position, and the patch strip 10, or patch board 10, is fed forward. This embodiment is advantageous, since for a successful air flow, the edges of the feed space 20 will have to be closed. The embodiment uses the punch means 7 for the closing, and so other, separate parts are not needed.

Figure 10:
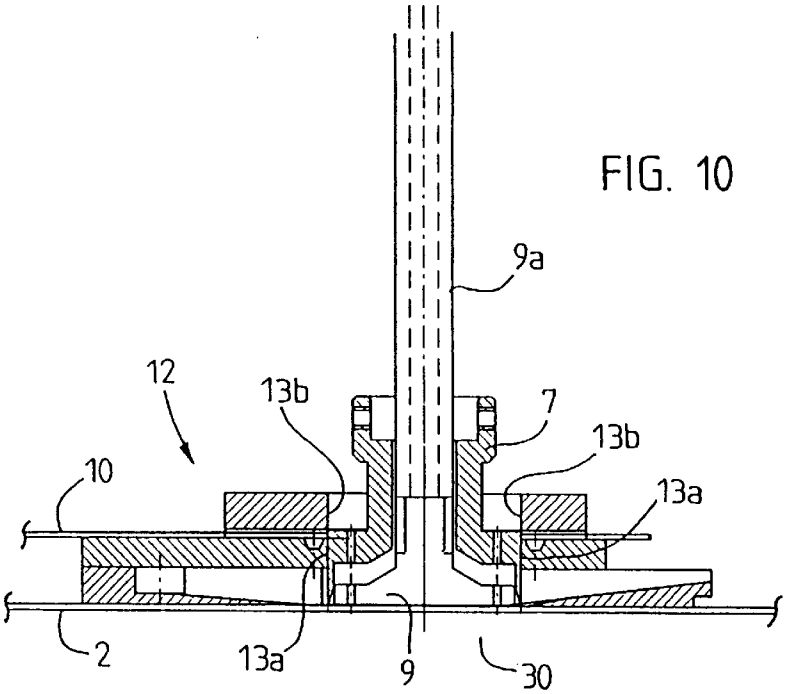
Figure 9:
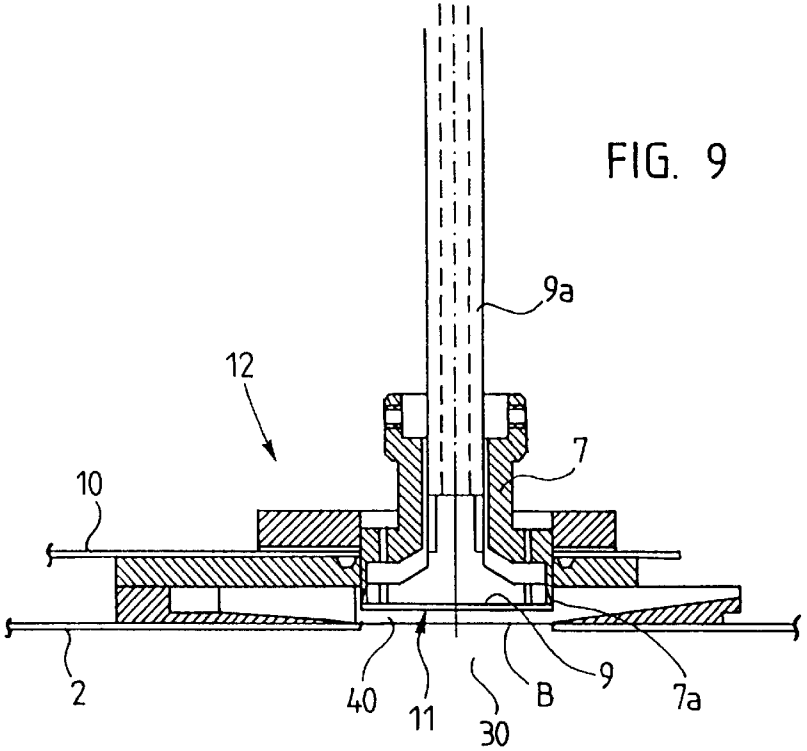

In FIG. 8, a patch board 10 or the like is placed below the punch means 7. In the method, preferably a veneer patch 11 is cut from the patch board 10 in accordance with FIG. 9. The patch 11 is cut from the patch board 10 by a linear downward movement of the punch means 7. When the patch 11 is cut from the patch board 10, the punch means 7 is pressed above the plywood board 2 through an opening 14*a* in the counterpart 14 below the patch board 10. In FIG. 10, the patch 11 is inserted into the plywood board 2 by moving the punch means 7 further down by a linear movement. In FIG. 10, the patch is placed in that point B of the plywood board 2 from which the defective portion A has been removed.

The patch 11 is cut from the patch board 10 and placed in the plywood board 2 using the same linearly moveable punch means 7 above the board with which the defective portion A has been removed from the plywood board 2 a moment earlier. The patch 11 is held attached to the punch means 7 against the pressing means 9 by means of suction.

In a method and apparatus of a preferred embodiment illustrated in FIG. 10, the patch 1, when it is put in place, is supported by a pressing means 9 arranged inside the punch means 7, the pressing means being pressed downward against the patch 11 by a linear movement. The pressing means 9 supports the patch 11 even in FIG. 9, where the punch means 7 and the pressing means 9 inside it press the patch 11 down.

Figure 11:
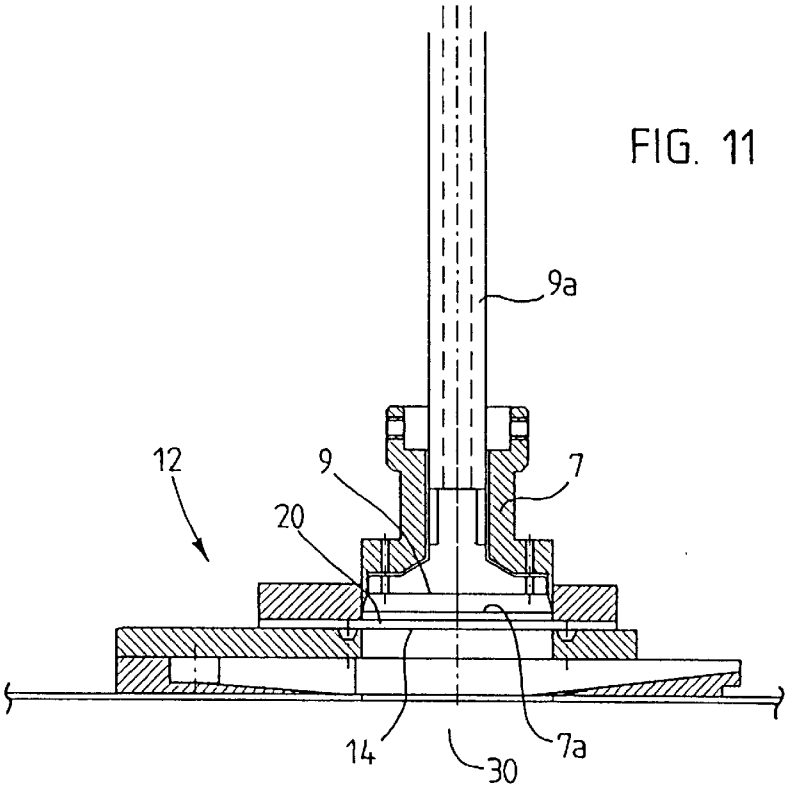

Finally, in FIG. 11 the punch means 7 and the pressing means 9 pull back, i.e. are raised, and stay in place waiting for the next cycle of operation.

As stated above, when the punch means is raised after cutting the defective portion, the defective portion A is first taken away and the patch board 10 is then placed below the punch means 7. In a preferred embodiment of the invention, the order of operations may be different, i.e. when the punch means has been raised, the patch board 10 can be first placed below the punch means 7 and the defective portion A then taken away. In the last-mentioned embodiment, the defective portion is easier to remove. In both cases, however, the defective portion detached from the plywood board is preferably detached from the punch means when the punch means is raised or immediately after it has been raised, before the next operation.

FIGS. 1 and 2 show that in a preferred embodiment the apparatus comprises (four) sensors attached to the frame 6*b* for detecting the position of the cam gear 8*b*, 8*c*, 8*e* and controlling its operation. This embodiment facilitates automation and provides a good place for the sensors. The sensors control the supply of the patch board 10, i.e. patch strip 10, the start of the rotation of the shaft 8*a* and thus the cam gear, and the operation of the suction and pressure.

Although the invention is described above with reference to the examples illustrated in the attached drawings, it is to be understood that the invention is not limited thereto but can be modified in many ways within the inventive idea disclosed in the attached claims.

We claim:

1. A method for patching plywood or the like by removing a defective portion from a plywood board with a linearly moveable punch means having a blade edge arranged above the plywood board and by cutting a patch from a patch board and placing the patch at that point of the plywood board from which the defective portion has been removed, comprising the steps of:

placing the plywood board on a counterplate with the defective portion aligned with the punch means;

lowering a patching unit to press the plywood board against the counterplate;

pressing the punch means downward through the plywood board against the counter plate to remove the defective portion from the plywood board;

raising the punch means;

placing the patch board above the plywood board and below the punch means;

moving the punch means linearly downward to cut a patch from the patch board with the punch means; and inserting the patch into the plywood board from which the defective portion had been removed by a further linear downward movement of the punch means.

2. A method according to claim 1, comprising the steps of raising the punch means step by step such that first, the punch means is raised to a height where a lateral side of the punch means closes a feed space into which the patch board is fed, and that second, before the patch board is placed in the feed space below the punch means, the punch means is raised at least to such an extent that the feed space is opened.

3. A method according to claim 1, comprising the steps of raising the defective portion cut from the plywood plate by the punch means, detaching the defective portion from the punch means with a pressing means arranged inside the punch means by moving the pressing means downward such that the defective portion is dropped from the punch means, and discharging the defective portion with an air flow above the plywood board.

4. A method according to claim 3, wherein the air flow is provided both from top to bottom in the direction of the punch means and transversely below the punch means.

5. A method according to claim 1, comprising the step of supporting the patch with the pressing means that is arranged inside the punch means when the patch is being put in place with the punch means and is being pressed downward by a linear movement.

6. A method according to claim 1, comprising the step of pressing the punch means from above the plywood board through an opening in a counterpart below the patch board when the patch is cut from the patch board.

7. A method according to claim 1, comprising the step of pressing the blade edge of the punch means at least slightly to a seam between the plywood board and the patch when the patch is put in place.

8. An apparatus for patching plywood or the like, the apparatus comprising a linearly moveable punch means with a blade edge arranged above a plywood board to be patched, the apparatus further comprising means for making the punch means move linearly through the plywood board and into engagement with a counter plate below the plywood board in order to remove a defective portion from the plywood board, the apparatus further comprising a feed space into which a patch board from which a necessary patch will be cut is fed, wherein the punch means used for the removal of the defective portion is also arranged to cut the patch from the patch board by a downward movement effected after raising the punch means and, by continuing the movement, to insert the patch into the plywood board.

9. An apparatus according to claim 8, comprising a support member by means of which the apparatus is pressed against the plywood board, wherein the support member further comprises a vertical space that is open from below to allow the punch means to move therein, the vertical space having lateral sides, the punch means bearing against the lateral sides of the vertical space, the vertical space extending through the feed space into which the patch board is fed, and the support member further comprising a counterpart which surrounds the vertical space below the feed space into which the patch board is fed.

10. An apparatus according to claim 8 wherein the punch means comprises a means for lifting the defective portion together with the punch means, the apparatus further comprising a means for dropping the defective portion from the punch means.

11. An apparatus according to claim 10 wherein the means for dropping the defective portion from the punch means comprises a pressing means arranged inside the punch means and means for moving the pressing means, wherein when the patch is inserted into the plywood board, the pressing means being arranged to support the patch.

12. An apparatus according to claim 11, wherein the blade edge of the punch means is at least slightly lower than the pressing means when the patch is inserted into the plywood board.

* * * * *